United States Patent [19]

Davidson

[11] 3,934,549

[45] Jan. 27, 1976

[54] TRANSFER APPARATUS

[75] Inventor: James R. Davidson, Rochester, N.Y.

[73] Assignee: Xerox Corporation, Stamford, Conn.

[22] Filed: Aug. 1, 1974

[21] Appl. No.: 493,594

[52] U.S. Cl. ..... 118/637; 355/15

[51] Int. Cl.[2] ..... G03G 15/16

[58] Field of Search ..... 118/637, 639; 117/17.5; 355/3 R, 15; 96/1.4

[56] References Cited

UNITED STATES PATENTS

| | | | |
|---|---|---|---|
| 2,959,153 | 11/1960 | Hider | 355/15 |
| 3,413,063 | 11/1968 | Young | 96/1.4 |
| 3,548,783 | 12/1970 | Knapp | 118/637 |
| 3,834,804 | 9/1974 | Bhagat et al. | 355/15 |
| 3,838,918 | 10/1974 | Fisher et al. | 355/3 R |

*Primary Examiner*—Mervin Stein
*Assistant Examiner*—Douglas Salser
*Attorney, Agent, or Firm*—H. Fleischer; J. J. Ralabate; C. A. Green

[57] ABSTRACT

An apparatus in which one component of at least a two component mix deposited on a support surface is transferred to a sheet of support material. Initially, the attractive force between the support surface and mix is reduced, preconditioning the mix. Thereafter, the other component of the pre-conditioned mix is removed from the support surface. The remaining one component of the pre-conditioned mix is then transferred from the support surface to the sheet of support material.

8 Claims, 4 Drawing Figures

TRANSFER APPARATUS

BACKGROUND OF THE INVENTION

This invention relates generally to an electrostatographic printing machine, and more particularly concerns an improved transfer system for use therein. In the process of electrostatographic printing, an electrostatic latent charge pattern is reproduced in viewable form. The field of electrostatography includes electrophotography and electrography. Electrophotography employs a photosensitive medium to form, with the aid of electromagnetic radiation, an electrostatic latent charge pattern. Electrography utilizes an insulating medium to form, without the aid of electromagnetic radiation, the electrostatic latent charge pattern. Transfer, which is the act of transferring toner particles deposited on the electrostatic latent charge pattern, in image configuration, to a sheet of support material, may be employed in either electrophotography or electrography. Hereinafter, an electrophotographic printing machine will be described as an illustrative embodiment of the foregoing process. This printing machine incorporates the features of transfer apparatus of the present invention.

In the process of electrophotograpic printing, for example, as disclosed in U.S. Pat. No. 2,297,691 issued to Carlson in 1942, and image bearing member or photosensitive element having a photoconductive insulating layer is charged to a substantially uniform potential in order to sensitize its surface. Thereafter, the charged photoconductive surface is exposed to a light image of an original document. As a consequence of the exposure, the charge is selectively dissipated in the irradiated areas in accordance with the light intensity projected onto the photoconductive surface creating an electrostatic latent image thereon. Development of the electrostatic latent image recorded on the photoconductive surface is achieved by bringing a developer mix into contact therewith. Typical developer mixes generally comprise dyed or color thermoplastic particles, known in the art as toner particles, which are mixed with coarser carrier beads, such as ferromagnetic granules. The developer mix is selected such that the toner particles acquire the appropriate charge relative to the electrostatic latent image recorded on the photoconductive surface. Frequently, some undesired carrier beads adhere to the photoconductive surface after the development of the electrostatic latent image. These adhering carrier beads are transferred to the sheet of support material contaminating and distorting the copy image. Consequently, it is highly desirable to minimize the number of carrier beads transferred to the sheet of support material.

Various prior art techniques have been developed to achieve this. For example, U.S. Pat. No. 3,287,150 issued to Lehman in 1966 describes a cascade development system wherein carrier beads as well as toner particles are deposited on the photoconductive surface. Thereafter, a magnetic member positioned closely adjacent to the photoconductive surface removes the carrier beads without disturbing the toner powder image deposited thereon. Similarly, co-pending application Ser. No. 312,554 filed in 1972 describes a cylindrical pick off roller positioning adjacent to a photoconductive surface to remove carrier beads deposited thereon during the development cycle. In addition, magnets have frequently been employed as seals for developer housings. One such example of this is described in co-pending application Ser. No. 477,946 filed in 1974. Finally, U.S. Pat. No. 3,713,736 issued to Sargis in 1973 discloses a magnetic cleaning roller covered with magnetizable particles positioned adjacent to the photoconductive surface after the transfer station. The magnetic cleaning roller removes residual toner particles from the photoconductive surface after the transfer of the toner particles to the sheet of support material.

None of the foregoing prior art references disclose pre-conditioning the carrier beads and toner particles adhering to the photoconductive surface prior to transferring the toner particles to the sheet of support material. It has been found that when the toner particles and carrier beads are pre-conditioned so as to reduce their attractive force between the photoconductive surface and subsequently subjected to a magnetic attraction, carrier beads are removed more completely than by either element alone or by both elements but with the magnetic attraction occurring prior to the pre-conditioning. In tests of one specific embodiment of this invention on an electrophotographic printing machine a significant reduction in carrier beads transferred to the support sheet was obtained. Without magnetic attraction and pre-conditioning approximately 3 times the acceptable number of carrier beads was transferred to the sheet of support material. With just pre-conditioning, this level was reduced somewhat. However, with the introduction of pre-conditioning and magnetic attraction the number of carrier beads transferred to the sheet of support material was reduced to a range of about 10 to 25 percent of the acceptable amount. Thus, it is necessary to pre-condition the toner particles and carrier beads prior to removing the carrier beads from the photoconductive surface if the carrier beads adhering to the support material are to be reduced reliably to an acceptable level.

Accordingly, it is a primary object of the present invention to improve the transfer apparatus by pre-conditioning the carrier beads and toner particles adhering to the photoconductive surface and removing the preconditioned carrier beads therefrom prior to transferring the toner particles to a sheet of support material.

SUMMARY OF THE INVENTION

Briefly stated, and in accordance with the present invention, there is provided an apparatus for transferring one component of at least a two component mix from a support surface to a sheet of support material.

In the particular apparatus illustrated, this is achieved by reducing means, removing means and transferring means. Reducing means is adapted to decrease the attractive force between the mix and the support surface pre-conditioning the mix. Removing means is arranged to separate the other component of the pre-conditioned mix from the support surface. Thereafter, the transferring means shifts the remaining one component of the pre-conditioned mix from the support surface to the sheet of support material.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
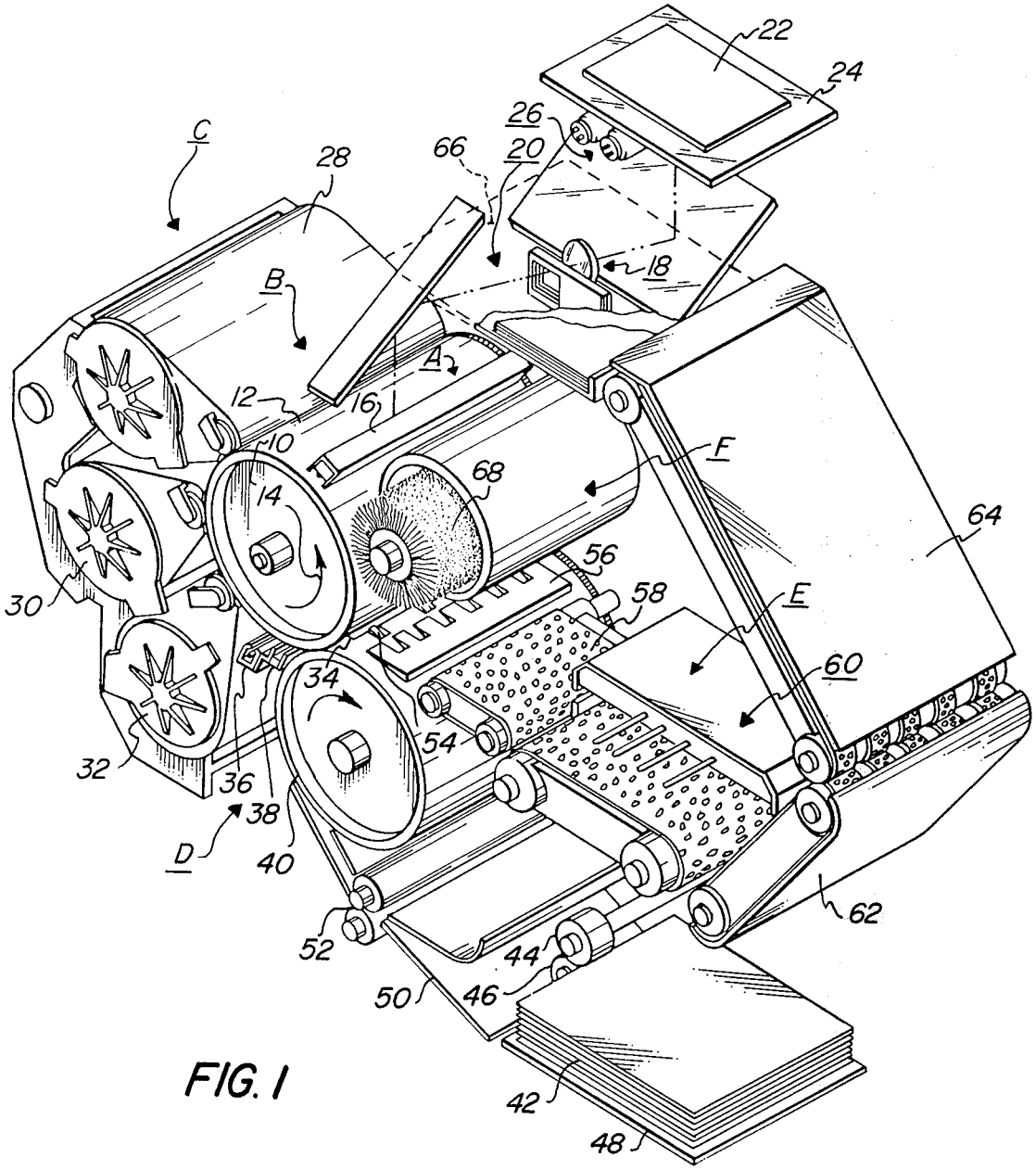
FIG. 1 is a schematic perspective view of a multicolor electrophotographic printing machine incorporating the features of the present invention therein.

For a general understanding of an electrophotographic printing machine in which the present invention may be incorporated, reference is had to FIG. 1 which depicts schematically the various system components for a color electrophotographic printing machine. Throughout this description, like reference numerals will be employed to designate like elements. Although the transfer apparatus of the present invention is particularly well adapted for use in the electrophotographic printing machine depicted in FIG. 1, it should become evident from the following discussion that it is equally well suited for use in a wide variety of electrostatographic printing machines and is not necessarily limited in its application to the particular embodiment shown herein.

As in all electrophotographic systems of the type illustrated, an image bearing member having a drum 10 with a photoconductive surface 12 adhering to the exterior circumferential surface thereof is rotated in the direction of arrow 14 through a series of processing stations. One type of suitable photoconductive material is described in U.S. Pat. No. 3,655,377 issued to Sechak in 1972.

Initially, photoconductive surface 12 passes through charging station A which sensitizes its surface. Charging station A has a corona generating device, indicated generally at 16, positioned closely adjacent to photoconductive surface 12. Corona generating device 16 charges photoconductive surface 12 to a relatively high substantially uniform potential. One type of suitable corona generating device is described in U.S. Pat. No. 2,778,946 issued to Mayo in 1957.

Thereafter, photoconductive surface 12 is rotated to exposure station B. At exposure station B, a color filtered light image of the original document is projected onto charged photoconductive surface 12 recording an electrostatic latent image thereon. Exposure station B includes a moving lens system, generally designated by the reference numeral 18, and a color filter mechanism shown generally at 20. A suitable moving lens system is disclosed in U.S. Pat. No. 3,062,108 issued to Mayo in 1962, and a suitable color filter mechanism is described in U.S. Pat. No. 3,775,006 issued to Hartman in 1973. In the illustrated machine, an original document 22 such as a sheet of paper, book or the like is placed face down upon a transparent viewing platen 24. Lamp assembly 26, filter mechanism 20 and lens 18 move in a timed relation with drum 10 to scan successive incremental areas of original document 22 disposed upon platen 24. In this manner, the charge pattern on photoconductive surface 12 is selectively discharged to record an electrostatic latent image corresponding to a single color of the original document.

After exposure, drum 10 rotates the single color electrostatic latent image recorded on photoconductive surface 12 to development station C. Development station C includes three individual developer units, generally indicated by the reference numerals 28, 30 and 32, respectively. A suitable development station employing a plurality of developer units is disclosed in co-pending application Ser. No. 255,259 filed in 1972. Each of the developer units comprises a magnetic brush roller adapted to position a developer mix of carrier beads and toner particles in contact with the electrostatic latent image. The carrier beads are generally made from a ferromagnetic material such as steel or nickel, while the toner particles are usually made from a heat settable thermoplastic material. The distinctions between each of the developer units resides primarily in the fact that they contain different colored toner particles therein. For example, developer unit 28 may contain yellow toner particles, developer unit 30 magenta toner particles, and developer unit 32 cyan toner particles. Each developer unit is activated sequentially so as to deposit toner particles on the electrostatic latent image complementary in color to the filtered light image. Thus, an electrostatic latent image formed from a green filtered light image is rendered visible by depositing magenta toner particles thereon. Similarly, latent images formed from blue and red light images are developed with yellow and cyan toner particles, respectively. A developed electrostatic lagent image is transported on drum 10 to transfer station D.

At transfer station D, the toner powder image adhering electrostatically to photoconductive surface 12 is transferred to a sheet of support material 34. Support material 34 may be plain paper or a sheet of thermoplastic material, amongst others. Transfer station D includes corona generating means, indicated generally at 36, and a transfer member, depicted generally by the reference numeral 40. Corona generator 36 is excited with an alternating current and arranged to spray ions on photoconductive surface 12 so as to pre-condition the toner particles and carrier beads adhering thereto. Pre-conditioning substantially reduces the electrostatic attraction between the photoconductive surface and the toner particles and carrier beads deposited thereon. It should be noted that not only are toner particles deposited on photoconductive surface 12 but carrier granules are deposited thereon as well. This is due to the fact that the sealing arrangement of the developer system is not ideal. Thus, each sheet of support material will include carrier beads as well as toner particles of the respective color. Carrier beads, on the sheet of support material, serve to mar or distort the copy of the original document. Thus, it is highly desirable to remove the carrier beads prior to their transfer to the sheet of support material. To this end, magnetic means 38 is positioned closely adjacent to photoconductive surface 12 between corona generator 36 and transfer member 40 so as to remove carrier beads on the photoconductive surface 12 prior to their transfer to the sheet of support material. After the carrier beads have been removed from photoconductive surface 12, the toner powder image is transferred to the sheet of support material 34. Support material 34 is secured releasably on transfer member 40. Transfer member 40 is a roll adapted to rotate in synchronism with drum 10. Thus, a plurality of toner powder images may be transferred to the sheet of support material in superimposed registration with one another. The transfer apparatus heretofore described will be discussed in greater detail with reference to FIGS. 2 and 3.

Support material 34 is advanced from a stack 42 of the sheets. Feed roll 44, in operative communication with retard roll 46, advances and separates successive uppermost sheets from the stack 42 disposed on tray 48. Each advancing sheet moves into chute 50 which directs it into the nip between register rolls 52. Thereafter, gripper fingers, indicated generally at 54, mounted on transfer roll 38 secure releasably thereon support material 34 for movement in a recirculating path therewith. After a plurality of toner powder images have been transferred to support material 34, gripper fingers 54 release support material 34 and space it from transfer roll 38. Stripper bar 56 is then interposed therebetween to separate support material 34 from transfer roll 38. An endless belt conveyor 58 advances support material 34 from transfer roll 38 to fixing station E.

At fixing station E, a fuser, designated generally by the reference numeral 60, permanently affixes the transferred toner powder image to support material 34. One type of suitable fuser is described in U.S. Pat. No. 3,498,592 issued to Moser et al. in 1970. After the fusing process, support material 34 is advanced by endless belt conveyors 62 and 64 to catch tray 66 for subsequent removal from the printing machine by the operator.

Invariably some toner particles remain on photoconductive surface 12 after the transfer thereof to the sheet of support material 34. These residual toner particles are removed at cleaning station F. Initially, toner particles are brought under the influence of a corona generating device (not shown) adapted to neutralize the remaining electrostatic charge on photoconductive surface 12 and the residual toner particles. The neutralized toner particles are cleaned from photoconductive surface 12 by a rotatably mounted fibrous brush 68 in contact therewith. A suitable brush cleaning device is described in U.S. Pat. No. 3,590,412 issued to Gerbasi in 1971.

It is believed that the foregoing description is sufficient for purposes of the present application to depict the general operation of a multi-color electrophotographic printing machine incorporating the teachings of the present invention therein.

Figure 2:
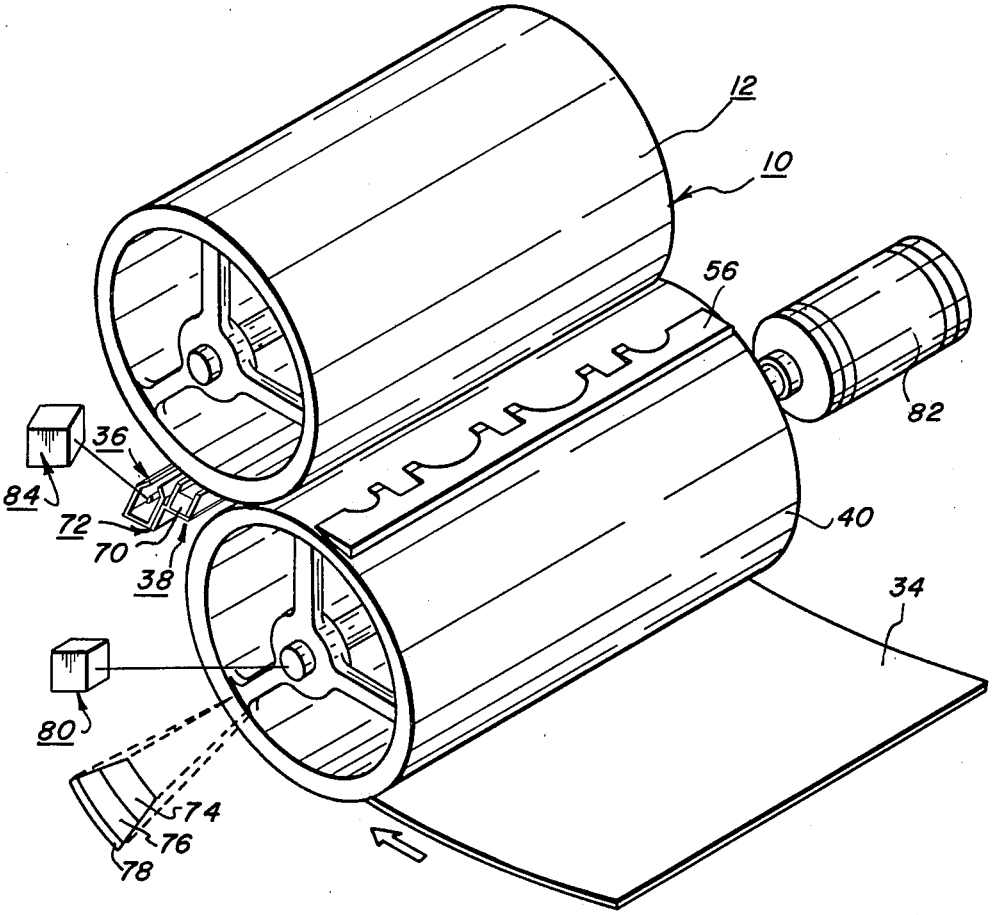
FIG. 2 is a schematic perspective view of the transfer apparatus employed in the FIG. 1 printing machine.
Figure 3:
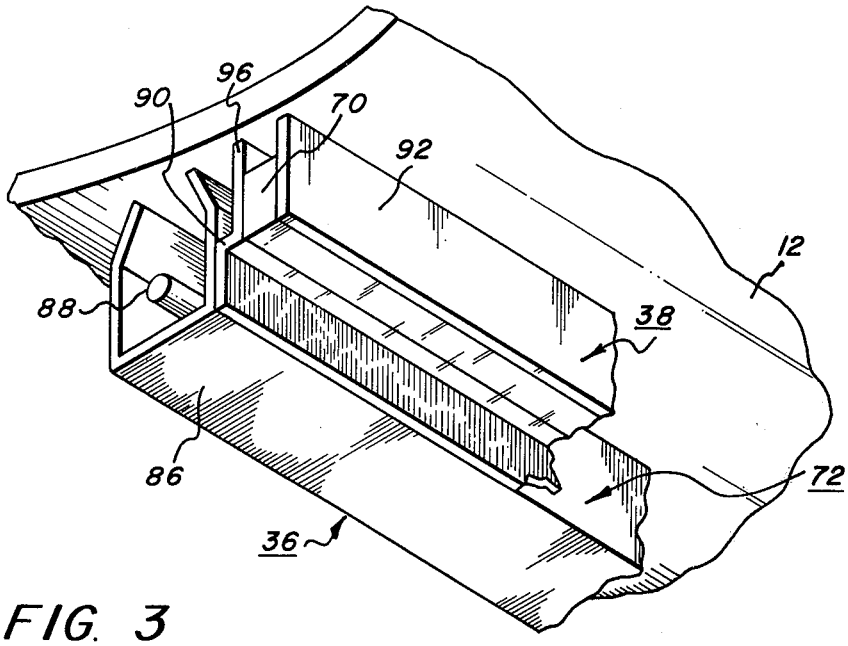
FIG. 3 is a fragmentary perspective view of the corona generator and magnetic member used in the FIG. 2 transfer apparatus.

Referring now to FIGS. 2 and 3, it can be seen that magnetic means 38 includes bar magnet extending across the width of photoconductive surface 12. Preferably, magnet 70 is made from a rubber matrix of magnetizable material secured to corona generating device 36 by means of a bracket indicated generally by the reference numeral 72.

Transfer roll 40 includes an aluminum tube 74 preferably having about ¼-inch thick layer of urethane 76 cast thereabout. A polyurethane coating 78, preferably of about 1 mil thick, is sprayed over the layer of cast urethane 76. A direct current bias voltage is applied to aluminum tube 74 via suitable means such as a carbon brush and brass ring assembly (not shown). Voltage source or power supply 80 excites transfer roll 40 at about 3000 volts. However, this voltage may range from about 1500 to about 4500 volts. Transfer roll 40 is sustantially the same diameter as drum 10 and is driven at the same speed. Support material 34 is interposed between transfer roll 40 and photoconductive surface 12 of drum 10. A synchronous drive motor rotates transfer roll 40 and drum 10. A flexible metal coupling 82 permits lowering and raising of transfer roll 40.

The discharge electrode of corona generator 36 is excited by high voltage AC power supply 84 at about 100 micro-amperes and at about 4400 volts RMS. This may range from about 80 micro-amperes at about 3000 volts RMS to about 200 micro-amperes at about 5000 volts RMS. The portion of this alternating current output from the discharge electrode of corona generator 36 impinging upon the toner powder image and photoconductive surface 12 may range from about 1 to about 5 micro-amperes.

Referring now to FIG. 3, corona generator 36 and magnetic means 38 are shown therein in greater detail. Corona generator 36 includes an elongated shield 86 preferably made from a conductive material such as an aluminum extrusion. Elongated shield 86 is substantially U-shaped and may be grounded or, in lieu thereof, biased to a suitable electrical voltage. A discharge electrode 88 is mounted in the chamber defined by the U-shaped shield 86. Discharge electrode 88 is preferably a coronode wire approximately 0.0035 inches in diameter and extends longitudinally along the length of shield 86. Coronode wire 88 is made preferably from platinum. As hereinbefore indicated power supply 84 excites discharge electrode 88 so as to produce a flow of ions therefrom. The ion flow is adapted to pre-condition the toner particles and carrier beads deposited on the electrostatic latent image of photoconductive surface 12. This reduces the electrostatic force securing the toner particle and carrier beads to photoconductive surface 12. In this way, magnetic means 38 may readily remove the carrier beads prior to the transfer of the toner powder image to the sheet of support material. The detailed structural configuration of the corona generating device and transfer member are described more fully in U.S. Pat. No. 3,838,918 issued to Fisher, et al. in 1974 the relevant portions of that disclosure being hereby incorporated into the present application.

With continued reference to FIG. 3, it can be seen that magnetic means 38 includes a bar magnet 70 which is mounted in a two piece bracket 72. Bracket 72 is secured adjustably to shield 86 of corona generator 36 by means of fasteners such as bolts or other suitable means. Bracket 72 includes plate 90 secured to shield 86. Plate 96 is integral with plate 90. Magnetic bar 70 is interposed between plates 96 and 92. Plates 92 and 96 are secured to one another by bolts passing from plate 92 through magnetic bar 70 to plate 96. Bracket 72 precisely locates magnetic bar 70 relative to photoconductive surface 12. It should be noted that the distance between the upper surface of plates 92 and 96 and photoconductive surface 12 is highly significant. If the spacing is too great, the magnetic field at photoconductive surface 12 may be too weak to remove carrier beads therefrom. Contrawise, if the spacing is too small, the accumulated carrier beads on magnetic member 70 and plates 92 and 96 may scrape and distort the toner powder image deposited on photoconductive surface 12. A satisfactory spacing has been found to be in the range of from 0.030 to 0.100 inches.

Figure 4:
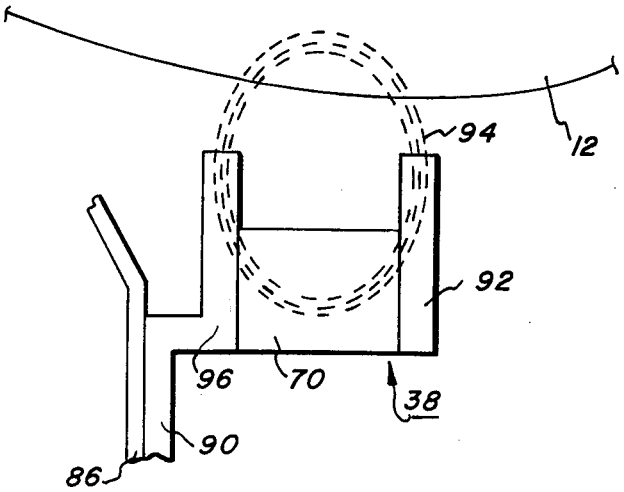
FIG. 4 is a fragmentary elevational view of the magnetic member shown in the FIG. 2 transfer apparatus.

Turning now to FIG. 4, there is shown magnetic means 38 operatively associated with photoconductive surface 12. Magnetic member 70 cooperates with plates 92 and 96, which are made from a magnetically permeable material, to form a magnetic field structure commonly referred to in the art as a "horseshoe magnet". In this way, the lines of magnetic flux 94 are directed in a substantially arcuate path between plates 92 and 96 at their upper edges. This configuration of magnetic field lines strongly attracts magnetic particles, i.e. carrier beads from photoconductive surface 12 to magnetic means 38.

In recapitulation, it is apparent that the transfer apparatus of the present invention includes a corona generating device adapted to pre-condition toner particles and carrier beads deposited on a photoconductive surface so as to reduce the attraction between the carrier beads and photoconductive surface. In view of the fact that the carrier beads are magnetic, magnetic means positioned after the corona generating device will remove a significant portion of the carrier beads from photoconductive surface 12. Thereafter, the toner particles are transferred from the photoconductive surface to the sheet of support material. This technique avoids image defects which are caused by carrier beads transferred from the photoconductive surface to the sheet of support material.

It is therefore evident that there has been provided, in accordance with this invention, an apparatus for transferring a toner powder image developed on a photoconductive surface which substantially reduces image defects produced by carrier beads. The foregoing apparatus satisfies the objects aims and advantages set forth above. While this invention has been described in conjunction with specific embodiments thereof, it is evident that many alternatives, modifications and variations will be apparent to those skilled in the art. Accordingly, it is intended to embrace all alternatives, modifications and variations as fall within the spirit and broad scope of the appended claims.

What is claimed is:

1. An apparatus for transferring one component of at least a two component mix from a support surface to a sheet of support material, including:

corona generating means disposed adjacent the support surface for applying an alternating charge potential to the support surface and mix adhering thereto to reduce the attractive force between the mix and the support surface so as to pre-condition the mix thereon;

a transfer member having the sheet of support material secured thereto, said transfer member being positioned closely adjacent to the support surface;

means for applying an electrical biasing potential to said transfer member to attract one component of the preconditioned mix from the support surface to the sheet of support material; and magnetic means interposed between said corona generating means and said transfer member to remove the other component of the pre-conditioned mix from the support surface so as to prevent the transfer thereof to the sheet of support material.

2. An apparatus as recited in claim 1, wherein said corona generating means includes:

an elongated shield defining an open ended chamber;

a corona discharge electrode mounted in the chamber of said shield; and means for energizing said discharge electrode to generate ions for charging a support surface and mix adhering thereto.

3. An apparatus as recited in claim 2, wherein said transfer member includes:

a cylindrical core of electrically conductive material;

a first layer of resilient material entrained about said cylindrical core and being substantially in contact therewith; and a second layer of resilient material entrained about said first layer of resilient material and being substantially in contact therewith.

4. An apparatus as recited in claim 3, wherein said magnetic means includes a magnetic bar positioned closely adjacent to the support surface and extending across the support surface such that during relative movement therebetween the entire support surface communicates with the magnetic field generated by said magnetic bar.

5. An electrostatographic printing machine of the type wherein toner particles and carrier beads are deposited on a surface having an electrostatic latent image recorded thereon with the toner particles being subsequently transferred to a sheet of support material, including:

corona generating means disposed adjacent the surface for applying an alternating charge potential to the surface, and toner particles and carrier beads adhering thereto to reduce the attractive force therebetween so as to pre-condition the toner particles and carrier particles thereon;

a transfer member having the sheet of support material secured thereto, said transfer member being positioned closely adjacent to the surface;

means for applying an electrical biasing potential to said transfer member to attract the pre-conditioned toner particles from the surface to the sheet of support material, and magnetic means interposed between said corona generating means and said transfer member to remove the pre-conditioned carrier beads from the surface so as to prevent the transfer thereof to the sheet of support material.

6. A printing machine as recited in claim 5, wherein said corona generating means includes:

an elongated shield defining an open ended chamber;

a corona discharge electrode mounted in the chamber of said shield; and means for energizing said discharge electrode to generate ions for charging the toner particles and carrier beads on the image bearing member.

7. A printing machine as recited in claim 6, wherein said transfer member includes:

a cylindrical core of electrically conductive material;

a first layer of resilient material entrained about said cylindrical core and being substantially in contact therewith; and a second layer of resilient material entrained about said first layer of resilient material and being substantially in contact therewith.

8. A printing machine as recited in claim 7, whrein said magnetic means includes a magnetic bar positioned closely adjacent to the image bearing member and extending across the image bearing member such that during relative movement therebetween the entire image bearing member surface having the carrier beads and toner particles deposited thereon communicates with the magnetic field generated by said magnetic bar.

* * * * *